US006435620B2

(12) United States Patent
MacNeil et al.

(10) Patent No.: US 6,435,620 B2
(45) Date of Patent: Aug. 20, 2002

(54) MULTIPLE JET HYDRODEMOLITION APPARATUS AND METHOD

(75) Inventors: Gerard MacNeil, Surrey; David MacNeil, Langley; Gordon MacNeil, Delta; Vernon Bose, Langley, all of (CA)

(73) Assignee: Mac & Mac Hydrodemolition, Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/814,761

(22) Filed: Mar. 23, 2001

Related U.S. Application Data

(63) Continuation-in-part of application No. 09/361,177, filed on Jul. 27, 1999, now Pat. No. 6,224,162.

(51) Int. Cl.[7] ..... E21C 45/00; E21C 23/09; E01C 23/09

(52) U.S. Cl. ..... 299/17; 299/36.1

(58) Field of Search ..... 299/17, 16, 36.1; 239/172, 251, 159

(56) References Cited

U.S. PATENT DOCUMENTS

| | | | |
|---|---|---|---|
| 4,074,858 A | 2/1978 | Burns et al. | |
| 4,081,200 A | 3/1978 | Cheung | |
| 4,854,770 A | 8/1989 | Puchala et al. | |
| 5,022,927 A | 6/1991 | Seidel | |
| 5,248,095 A | 9/1993 | Rankin et al. | |
| 5,255,959 A | 10/1993 | Loegel | |
| 5,361,993 A | 11/1994 | Andersson | |
| 6,010,079 A | 1/2000 | Mayfield, Jr. et al. | |

FOREIGN PATENT DOCUMENTS

| | | |
|---|---|---|
| DE | 3325909 A1 | 1/1985 |

*Primary Examiner*—David Bagnell
*Assistant Examiner*—John Kreck
(74) *Attorney, Agent, or Firm*—Hall, Priddy, Myers & Vande Sande

(57) ABSTRACT

Apparatus for the hydrodemolition of concrete layer including a movable vehicle, a bed having a guideway extending transversely to a direction of movement of the vehicle, a nozzle assembly having a guide slidably engaging the guideway and a plurality of nozzles spaced apart in a direction transverse to the guideway, separate fluid flow controllers coupled between a pressurized source of fluid and respective nozzles, the nozzles being oriented to spray a fluid jet onto the concrete surface and means for moving the nozzle assembly along the guideway transversely across the direction of travel.

25 Claims, 3 Drawing Sheets

MULTIPLE JET HYDRODEMOLITION APPARATUS AND METHOD

RELATED APPLICATIONS

This application is a continuation-in-part of U.S. patent application Ser. No. 09/361,177, filed Jul. 27, 1999, U.S. Pat. No. 6,224,162 and entitled MULTIPLE JET HYDRODEMOLITION APPARATUS AND METHOD.

FIELD

The present invention relates to a multiple jet hydrodemolition apparatus and method in which multiple hydrodemolition nozzles are operated to cover a greater area in a single pass than a unit with a single nozzle. The term hydrodemolition is sometimes referred to as hydromilling or hydroplaning.

BACKGROUND

Many concrete surfaces whether in parking lots, over bridges, on tunnel walls, building walls or any other concrete surface are frequently accompanied by heavy steel reinforcement. Once cracks in the concrete develop, road salts corrode the steel. This corrosion accelerates the destructive cycle of moisture, salt, freeze-thaw, corrosion, vibration and traffic. Conventional methods of repairing these concrete surfaces involves first the removal of the deteriorated concrete surface around and below the reinforcing steel bars. This removal allows placement of new concrete surface over the reinforcing steel.

Ordinarily concrete removal has been accomplished by jackhammers, but the use of jackhammers is time-consuming, and costly and makes it difficult to achieve complete removal of deteriorated concrete. In addition, the use of a jackhammer causes microcracking of the remaining concrete in surrounding areas. In order to improve the speed and efficiency of concrete removal from bridge decks, highways, substructures and parking garages and, at the same time, avoiding the problems caused by microcracking, contractors began using high-pressure water jets to remove the concrete. The use of high pressure water jets, termed hydrodemolition, involves moving an oscillating or rotating nozzle back and forth across a bed for a number of passes and then indexing or advancing a vehicle on which the bed and nozzle are supported to a next position where the process is repeated until a desired depth of concrete deck surface has been removed. The removal leaves clean reinforcing rod which has been descaled but otherwise undamaged and a rough textured concrete surface under the reinforcing rod which is ideal for bonding of new overlay. All deteriorated concrete is removed and entrained chlorides washed away. There is a greatly reduced noise and no vibration or dust.

The conventional equipment used in hydrodemolition has one nozzle, which runs over a guide bed and traverses a swath to be treated. After each pass the machine is indexed until a region has been impacted by one traversal. The vehicle is then reversed and the process repeated with the machine moving in indexes in reverse. Again once the swath has been covered the vehicle is moved forward in an indexed manner and traversals of the nozzle are repeated until the swath has been covered three times. Ordinarily three such passes are required to complete the hydrodemolition. Since the cost of a job is directly proportional to the time taken to accomplish it, there is a need for a faster more efficient method of applying hydrodemolition than that currently used. Some conventional equipment will complete a number of passes in a given position before being indexed forward where a like number of passes is then completed.

Accordingly, it is an object of the invention to provide an improved method and apparatus for applying hydrodemolition. It is a further object to provide a faster method of treating a surface with hydrodemolition than is currently in use.

SUMMARY OF THE INVENTION

According to the invention there is provided an apparatus for hydrodemolition having a movable vehicle, a fluid jet assembly having at least three nozzles, one behind the other, coupled to said vehicle and each oriented to direct a jet of fluid onto an underlying concrete surface, a bed coupled to the vehicle for guiding the nozzles back and forth transverse to a direction of movement of the vehicle, a fluid flow controller coupled to each of the nozzles from a source of high pressure fluid such that the fluid flow to each nozzle is independently controlled and means for moving the nozzles back and forth.

Preferably, the nozzles are one of rotatable and oscillatory and direct fluid at an angle to the vertical so that it can clean around reinforcing steel. Advantageously, the pressure of fluid supplied to each nozzle is independently controllable. Advantageously, the nozzles may be mounted at progressively lower positions, with respect to the subject concrete surface, such that, as layers of concrete are stripped away, the nozzles are maintained at an optimal distance from the subject concrete surface.

In another aspect of the invention there is provided a method of hydrodemolition which includes making a first transverse pass across a surface to be treated with a first fluid jet from a first fluid nozzle, and incrementing said first fluid nozzle forwardly and making transverse passes at each incremental position until a second nozzle reaches the position of the first transverse pass and then turning on the fluid to said second nozzle so that the second nozzle impacts the same region as did the first nozzle during the fist pass. The first and second nozzles make transverse passes and are incremented forward until a third nozzle reaches the position of the first transverse pass. Fluid to the third nozzle is then turned on so that the third nozzle impacts the same region as did the first nozzle during the first pass. Next the first, second and third nozzles are incremented repeatedly until the first fluid jet impacts on a last transverse pass after which the first nozzle is turned off. The second nozzle is incremented repeatedly until it reaches a position of the last transverse pass after which it is turned off. The third nozzle is incremented repeatedly until it reaches the position of the last transverse pass. After completing the last transverse pass the third nozzle is turned off.

In an alternate embodiment of the invention there is provided a method of hydrodemolition which includes making a first transverse pass across a surface to be treated with a first fluid jet from a first nozzle, and moving said first nozzle forward continuously and making transverse passes until a second nozzle reaches the position of the first transverse pass and then turning on the fluid to said second nozzle so that the second fluid jet impacts the same region as did the first fluid jet during the fist pass. The first and second nozzles move forward continuously and make transverse passes until a third nozzle reaches the position of the first transverse pass and then fluid to said third nozzle is turned on so that the third fluid jet impacts the same region as did the first fluid jet during the first pass. The first, second and third nozzles move forward continuously and make transverse passes until the first fluid jet impacts on a last transverse pass of the subject surface after which it is turned off. The second fluid jet moves forward continuously and makes transverse passes until it reaches a position of the last transverse pass of the subject surface after which it is turned off. The third fluid jet moves forward continuously and makes transverse passes until it reaches a position of the last transverse pass of the subject surface. After completing the last transverse pass the third nozzle is turned off.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
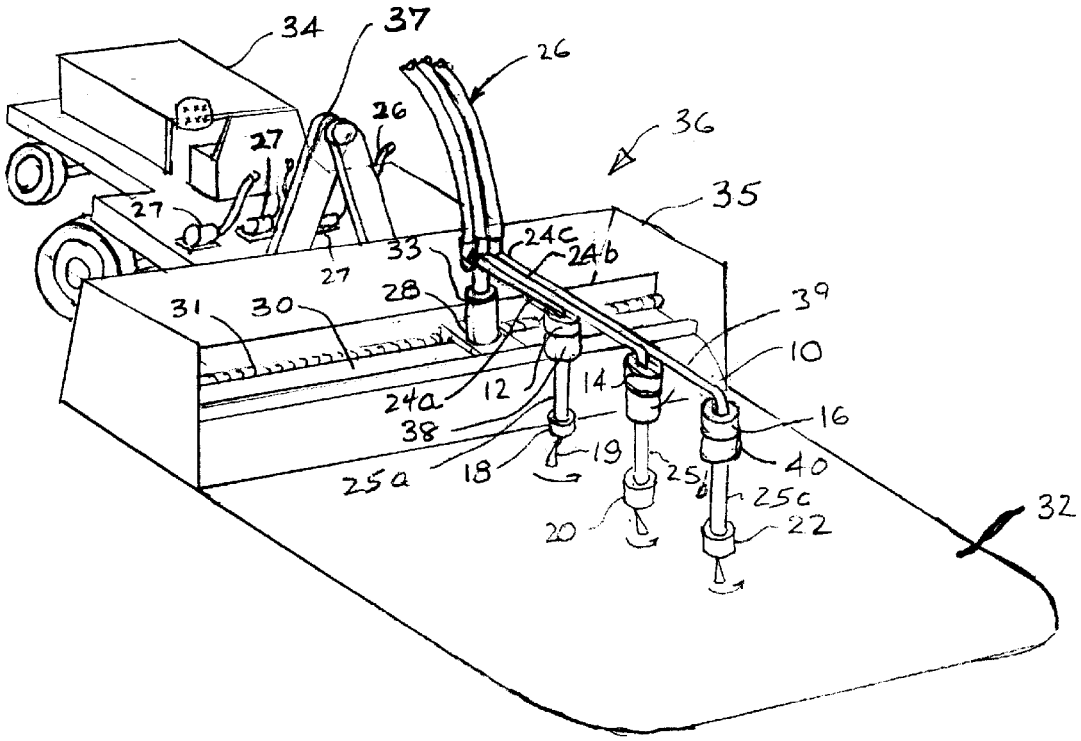
FIG. 1 is a perspective view of a hydrodemolition unit with applicant's invention.

Referring to FIG. 1 a self-propelled vehicle 34 tows a hydrodemolition unit 36 over a concrete deck 32. The hydrodemolition unit 36 has a carriage 35 to which is mounted a guideway 30 and a guide 28 movable along the guideway 30 by means of a lead screw 31 threadedly engaging a threaded hole in the guide 28. A nozzle assembly 10 is affixed to the guide 28 consisting of three distributor pipes 24*a*, 24*b* and 24*c*, coupled to respective electronically actuated valves 12, 14 and 16, which, in turn, are coupled to respective exchangers 38, 39, and 40. The valves 12 can also be actuated hydraulically, by air pressure or manually. Exchanger 38, 39, and 40 couple the high pressure water to rotating nozzles 18, 20, and 22, respectively. Nozzles 18, 20, and 22 are positioned one behind another in the direction of travel of vehicle 34 and are independently controllable and pressurized by three separate pumps 27 to permit fluid under pressure through each of nozzles 18, 20, and 22. The spacing of the nozzles 18, 20, and 22 is in the range of ½ inch to 10 inches. However, other spacings could be used. Three hoses 26 couple to respective ones of three pumps 27. A piston cylinder unit 33 permits vertical adjustment of the nozzle assembly 10. Alternatively, manual replacement of the nozzle pipe 25 for each of nozzles 18, 20, 22 could be used to adjust the nozzle position. Instead of using separate pumps for each nozzle it is possible to use a single large pump for two or more nozzles with one of more splitters to divide the water equally between the nozzles when all are active.

Carriage 35 is attached to vehicle 34 by an articulating hydraulically operated arm (not shown) that can move carriage 35 into a horizontal, vertical or inverted position so that walls and ceilings can be treated as well as floors or decks.

Figure 2:
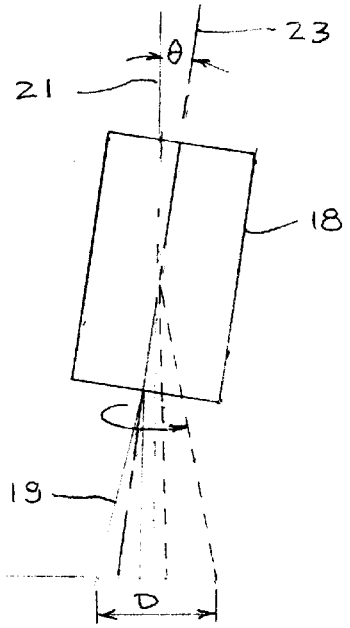
FIG. 2 is a front elevation view showing the orientation of mounting the nozzles.

Referring to FIG. 2, each nozzle 18, 20, and 22 is mounted to a nozzle receptacle at the end of respective rotating pipes 25*a*, 25*b*, and 25*c*, respectively, so that each nozzle axis 23 (see FIG. 2 which shows nozzle 18 as representative of all of the nozzles 18, 20 and 22) is at a slight angle to a vertical axis 21. The nozzles 18, 20, and 22 are rotated or oscillated about the vertical axis 21 so that a water jet 19 emitted by each nozzle rotates about the vertical axis 21 producing a blast diameter D. The purpose of this arrangement is to permit the water jet to impact slightly under reinforcing rod (not shown) that is often embedded in the concrete to facilitate removal of any concrete bonded to the rod. The spacing of nozzles 18, 20, and 22 is approximately 6 inches but could be shorter or even longer. The blast diameter or amount of concrete removed by a rotating jet depends on the state of the concrete. Concrete that has deteriorated is easier to remove than concrete without any degradation.

Figures 3A, 3B, 3C, 3D, 3E, 3F, 3G:
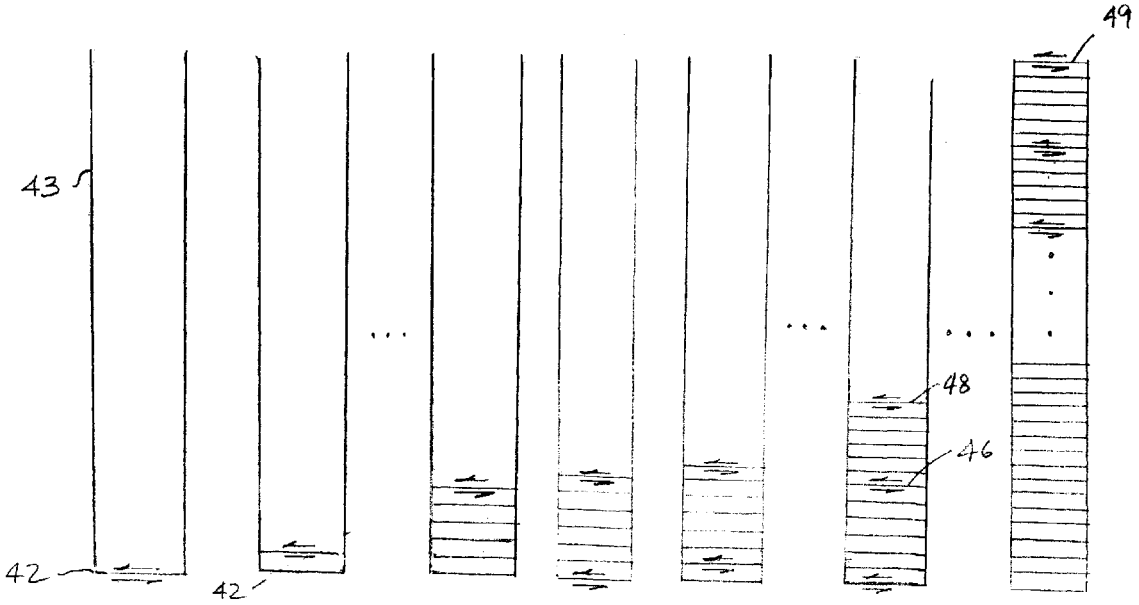
FIGS. 3(*a*) to 3(*g*) are schematic drawings showing the sequence of start up and ending steps by a three nozzle unit which moves forward incrementally.

Referring to FIGS. 3(*a*) to 3(*g*), the method by which a swath 43 of concrete decking, roadway, wall or ceiling is treated, by moving nozzles 18, 20 and 22 forward incrementally. In FIG. 3(*a*) the process is commenced by turning on the water to the first nozzle 18 and allowing it to traverse a first pass 42 across the swath 43 of a concrete surface. The first nozzle 18 is moved incrementally forward and subsequent transverse passes are made at each incremental position until the second nozzle 20 reaches the position of the first pass 42 at which time water to the second nozzle 20 is turned on. The second nozzle 20 traverses the first pass across the swath and then further incremental movements forward are made. At each incremental position both the first and second nozzles 18 and 20, respectively, concurrently make a back and forth transverse movement spraying jets of water onto the swath 43 until the third nozzle 22 reaches the position of the first pass 42. Water is then turned on to the third nozzle 22 which traverses the first pass 42 while nozzles 18 and 20 concurrently make transverse passes 46 and 48 as shown in FIG. 3(*f*). Indexing of the transport vehicle 34 continues until the end of swath 43 (see FIG. 3(*g*)) has been reached. After traversing the last pass 49, water to the first nozzle 18 is turned off. The vehicle 34 is further moved forward incrementally and a second nozzle 20 is turned off after completing traversal of the last pass 49. The incremental movement continues until the last nozzle 22 reaches the last pass 49 which it traverses before water to it is shut off. The size of the movement increments of vehicle 34 is normally equal to the blast diameter of the nozzles.

The present invention also encompasses a method of hydrodemolition wherein nozzles 18, 20 and 22 are moved forward continuously. The process is commenced by turning on the water to the first nozzle 18 and allowing it to traverse a first pass across a swath of a concrete surface. Then the first nozzle 18 is moved forward continuously as it traverses the swath until the second nozzle 20 reaches the position of the first pass 42 at which time water to the second nozzle 20 is turned on. Both the first and second nozzles 18 and 20 concurrently traverse the swath spraying jets of water onto the swath as they are moved forward continuously until the third nozzle 22 reaches the position of the first pass. Water is then turned on to the third nozzle 22 which traverses the first pass while nozzles 18 and 20 concurrently make transverse passes. This process continues until the first nozzle 18 traverses the last pass 49, when water to the first nozzle 18 is turned off. The vehicle 34 continues to move forward continuously and a second nozzle 20 is turned off after completing traversal of the last pass. The continuous movement continues until the last nozzle 22 traverses the last pass and water to the third nozzle 22 is shut off.

The rate of continuous forward movement of vehicle 34 is determined by state of the concrete surface being treated, the number of nozzles being used, the rate at which the nozzles traverse the direction of travel of the vehicle 34, the blast diameter of the nozzles and the pressure and volume of water.

Whether the nozzles 18, 20 and 22 are moved forward continuously or incrementally, the amount of concrete removed at any one pass is proportional to the dwell time, the pressure and the volume of water. Generally, weakened concrete will be removed preferentially by the current system over good quality concrete.

The rate of water consumption with the present method is greater than with conventional methods, since the speed of processing is considerably greater than with conventional methods. Obviously, the increments of movement are chosen to suit the depth of concrete to be removed.

Figure 4:
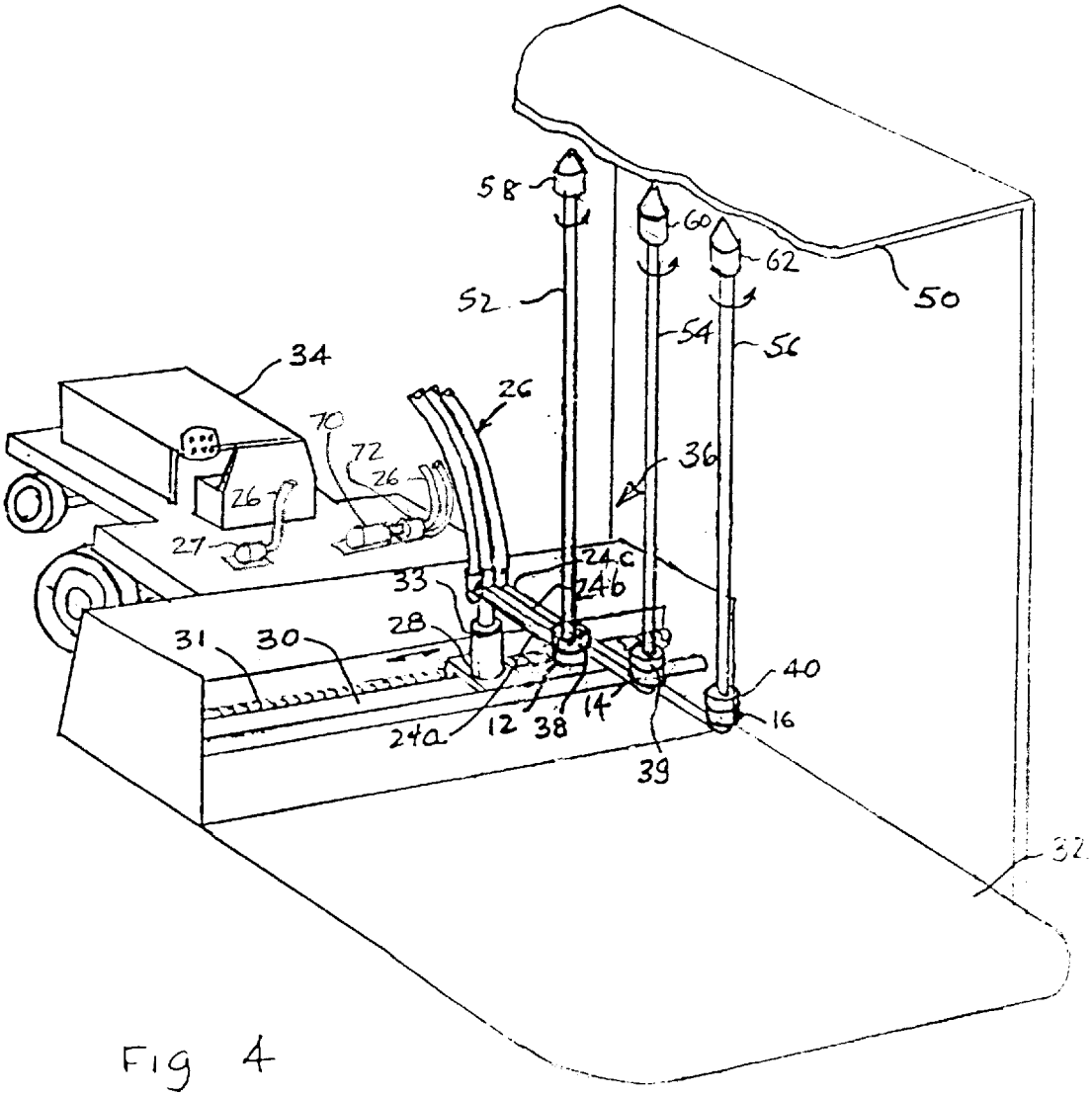
FIG. 4 is a variant of FIG. 1 in which long rotating pipes extend upwardly so that nozzles fitted to distal ends of the pipes can spray a ceiling.

Referring to FIG. 4, long pipes 52, 54, and 56 are installed so that they extend upwardly from exchangers 38, 39, and 40 which are reoriented upwardly by rotating distributor pipes 24*a*, 24*b*, and 24*c* through 180 degrees. Nozzles 58, 60, and 62 are installed in nozzle receptacles at the end of respective pipes 52, 54, and 56 at an acute angle to the vertical and the pipes 52, 54, and 56 rotated by respective exchangers 38, 39, and 40. Pump 27 pressurizes water for nozzle 58 while large pump 70 pressurizes water for nozzles 60 and 62 utilizing a splitter 72 to split the water flow between the two nozzles while maintaining a constant pressure on each. The procedure is otherwise the same as that described for the system of FIG. 1.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. Apparatus for the hydrodemolition of a concrete surface, comprising:

(a) a vehicle capable of movement along a direction of travel;

(b) a bed extending transversely to the direction of travel of said vehicle;

(c) a nozzle assembly so constructed to achieve hydrodemolition of said concrete surface having a plurality of nozzles spaced apart in a direction transverse to said bed wherein each nozzle is oriented so as to direct a fluid jet emitted therefrom at said concrete surface having its axis of flow at an acute angle to a notional line coincident to an axis of said nozzle perpendicular to said concrete surface and said nozzles are one of rotatable or oscillatory, whereby each nozzle cuts a swath of concrete by hydrodemolition; and (d) an actuating mechanism coupled to said nozzle assembly operative to move said nozzle assembly back and forth along said bed.

2. The apparatus of claim 1, wherein a separate fluid pump is provided for each nozzle.

3. The apparatus of claim 1, including at least one splitter in a pump outlet water line operative to split water flow equally between nozzles.

4. The apparatus of claim 1, wherein the number of nozzles is three.

5. The apparatus of claim 1, wherein the separation of each nozzle from an adjacent one is in the range of ½ inch to 10 inches.

6. The apparatus of claim 1, wherein said nozzles are aligned along a direction of travel of said vehicle and move together transversely.

7. The apparatus of claim 1, including a plurality of fluid flow controllers coupled to respective nozzles of said plurality of nozzles operative to control fluid flow to each nozzle independently of all other nozzles.

8. The apparatus of claim 1, wherein said vehicle moves along said direction of travel continuously or in incremental steps.

9. The apparatus of claim 1, wherein said plurality of nozzles are positionable at progressively lower positions with respect to said concrete surface.

10. A method of hydrodemolition of a swath of a concrete surface, comprising:

(a) directing a jet of fluid under pressure emitted from a first nozzle against a first transverse region of said swath and moving said nozzle across said swath in a direction transverse to the direction of travel of the vehicle;

(b) repeatedly moving said first nozzle ahead incrementally in a direction of travel and at each incremental position moving said first nozzle transversely across said swath until a second nozzle spaced rearwardly of said first nozzle overlies said first transverse region;

(c) directing fluid from said first and second nozzles against said concrete surface, and moving them transversely to said direction of travel;

(d) repeatedly moving said first and second nozzles ahead incrementally in a direction of travel and at each incremental position moving said first and second nozzles transversely across said swath until a third nozzle spaced rearwardly of said second nozzle overlies said first transverse region;

(e) repeatedly moving said first, second and third nozzles ahead incrementally and directing fluid jets emitted from said first, second and third nozzles against said concrete surface and moving them transversely to said direction of travel at each incremental position until a desired swath has been covered by said first nozzle;

(f) turning off fluid from said first nozzle and continuing to incrementally move said second and third nozzles forward and, at each incremental position to move said second and third nozzles transversely to the direction of travel until the last transverse position of said swath has been traversed by movement of said second nozzle;

(g) turning off fluid from said second nozzle and continuing to incrementally move said third nozzle forward and, at each incremental position to move said third nozzle transversely to the direction of travel until the last transverse position of said swath has been traversed by movement of said third nozzle; and (h) turning off fluid from said third nozzle.

11. The method of claim 10, wherein the amount of incremental movement is substantially equal to the blast diameter of said fluid jets.

12. The method of claim 10, including mounting said first, second and third nozzles at an acute angle to notional lines through an axis of said nozzles and perpendicular to said concrete surface and wherein said first, second and third nozzles are one of rotating and oscillating.

13. The method of claim 10, wherein said plurality of nozzles are positioned at progressively lower positions with respect to said concrete surface.

14. A method of hydrodemolition of a swath of a concrete surface, comprising:

(a) directing fluid under pressure from a first nozzle of N nozzles spaced by a predetermined amount in a direction of travel along said swath against a first transverse strip of said concrete surface and moving said first nozzle transversely to the direction of travel across said swath;

(b) repeatedly, incrementally moving said N nozzles ahead in a direction of travel by an incremental distance and at each incremental position moving said first nozzle transversely to the direction of travel across said swath until a second nozzle spaced rearwardly of said first nozzle overlies said first transverse strip;

(c) directing fluid under pressure from the first and second nozzles against a first and second strip of said concrete surface, and moving them transversely to said direction of travel;

(d) repeatedly moving said N nozzles ahead by the incremental distance and successively directing fluid from the remaining nozzles of said N nozzles and moving the nozzles transversely across the direction of forward travel until all N nozzles have directed spray over said first transverse strip in turn;

(e) repeatedly moving said N nozzles ahead by the incremental distances and directing fluid under pressure from all N nozzles against said concrete surface while all N nozzles make a transverse pass until said first nozzle reaches a last incremental position of said swath;

(f) after said first nozzle has made a transverse pass spraying said last incremental position, turning off fluid from said first nozzle and moving said N nozzles ahead by the incremental distance;

(g) repeatedly incrementing said second nozzle and moving it transversely across the swath at each incremental position until it reaches and traverses a last incremental position of said swath; and (h) turning off fluid from said second nozzle and moving said N nozzles ahead successively by incremental distances and completing transverse passes across said swath by each of said N nozzles and shutting off water to said each nozzle once it has completed a transverse pass.

15. The method of claim 14, wherein the N is three.

16. The method of claim 14, wherein said N nozzles are each at an acute angle to respective notional lines through axes of said nozzles and each of said N nozzles one of rotates and oscillates.

17. The method of claim 14, wherein said nozzles are aligned along the direction of travel and move transversely to the direction of travel together.

18. The method of claim 14, wherein fluid pressure to each of said nozzles is independently controlled.

19. The method of claim 14, wherein said N nozzles are positioned at progressively lower positions with respect to said concrete surface.

20. A method of hydrodemolition of a swath of a concrete surface, comprising:

(a) directing fluid under pressure from a first nozzle of N nozzles spaced by a predetermined amount in a direction of travel along said swath against a first transverse strip of said concrete surface and moving said first nozzle transversely to the direction of travel across said swath;

(b) continuously moving said N nozzles ahead in a direction of travel and moving said first nozzle transversely to the direction of travel across said swath until a second nozzle spaced rearwardly of said first nozzle overlies said first transverse strip of said swath;

(c) directing fluid under pressure from the first and second nozzles against a first and second strip of said concrete surface, and moving them transversely to said direction of travel;

(d) continuously moving said N nozzles ahead and successively directing fluid under pressure from each one of said N nozzles as each one of said N nozzles comes to overlie said first transverse strip of said swath and moving said N nozzles transversely across said swath until all N nozzles have directed spray over said first transverse strip in turn;

(e) continuously moving said N nozzles ahead and directing fluid under pressure from all N nozzles against said concrete surface while all N nozzles make transverse passes across said swath until said first nozzle reaches a last position of said swath;

(f) after said first nozzle has traversed and sprayed said last position of said swath, turning off fluid from said first nozzle and continuously moving said N nozzles ahead and transversely across said swath;

(g) continuously moving said N nozzles ahead and transversely across said swath until said second nozzle reaches and traverses said last position of said swath;

(h) turning off fluid from said second nozzle and continuously moving said N nozzles ahead and transversely across said swath; and (i) continuously moving said N nozzles ahead and transversely across said swath and successively shutting off fluid to each one of said N nozzles once each one of said N nozzles has traversed and sprayed said last position of said swath.

21. The method of claim 20, wherein N is three.

22. The method of claim 20, wherein said N nozzles are each at an acute angle to respective notional lines through axes of said nozzles and perpendicular to said concrete surface and wherein each of said N nozzles is one of rotating and oscillating.

23. The method of claim 20, wherein said nozzles are aligned along the direction of travel and move transversely to the direction of travel together.

24. The method of claim 20, wherein fluid pressure to each of said nozzles is independently controlled.

25. The method of claim 20, wherein said N nozzles are positioned at progressively lower positions with respect to said concrete surface.

* * * * *